United States Patent [19]

Sato

[11] Patent Number: 4,847,448

[45] Date of Patent: Jul. 11, 1989

[54] COAXIAL CABLE

[75] Inventor: Kazuhiro Sato, Tochigi, Japan

[73] Assignee: Sumitomo Electric Industries, Ltd., Osaka, Japan

[21] Appl. No.: 190,173

[22] Filed: May 4, 1988

[30] Foreign Application Priority Data

Jul. 21, 1987 [JP] Japan ..... 62-182829

[51] Int. Cl.[4] ..... H01B 7/34

[52] U.S. Cl. ..... 174/103; 174/36; 174/106 R; 174/108; 333/243

[58] Field of Search ..... 174/103, 106 R, 36, 174/108; 333/243

[56] References Cited

U.S. PATENT DOCUMENTS

| | | | |
|---|---|---|---|
| 1,861,182 | 5/1932 | Hendey et al. | 174/106 R |
| 2,150,783 | 3/1939 | Rist | 174/108 |
| 2,243,851 | 6/1941 | Booth et al. | 174/36 |
| 2,447,168 | 8/1948 | Dean et al. | 174/36 |
| 3,090,825 | 5/1963 | Volk | 174/109 |
| 3,217,094 | 11/1965 | Volk | 174/36 |
| 3,274,329 | 9/1966 | Timmons | 174/108 |
| 3,339,007 | 8/1967 | Blodgett | 174/36 |
| 4,250,351 | 2/1981 | Bridges | 174/108 X |

FOREIGN PATENT DOCUMENTS

| | | | |
|---|---|---|---|
| 216883 | 8/1958 | Australia | 174/106 R |
| 2385194 | 11/1978 | France | 174/106 R |

*Primary Examiner*—Morris H. Nimmo

*Attorney, Agent, or Firm*—Cushman, Darby & Cushman

[57] ABSTRACT

A coaxial cable having a tape with a metal deposited thereon which is wound over a laterally wound shielding layer which is, in turn, formed over an insulation layer about the conductor. The tape includes a plastic tape and a metal layer deposited on the plastic tape, and the tape is disposed such that the metal layer is in contact with the laterally wound shielding layer. Improved high frequency shielding characteristics are obtained using this structure without sacrificing cable flexibility.

5 Claims, 2 Drawing Sheets

Fig. 2.
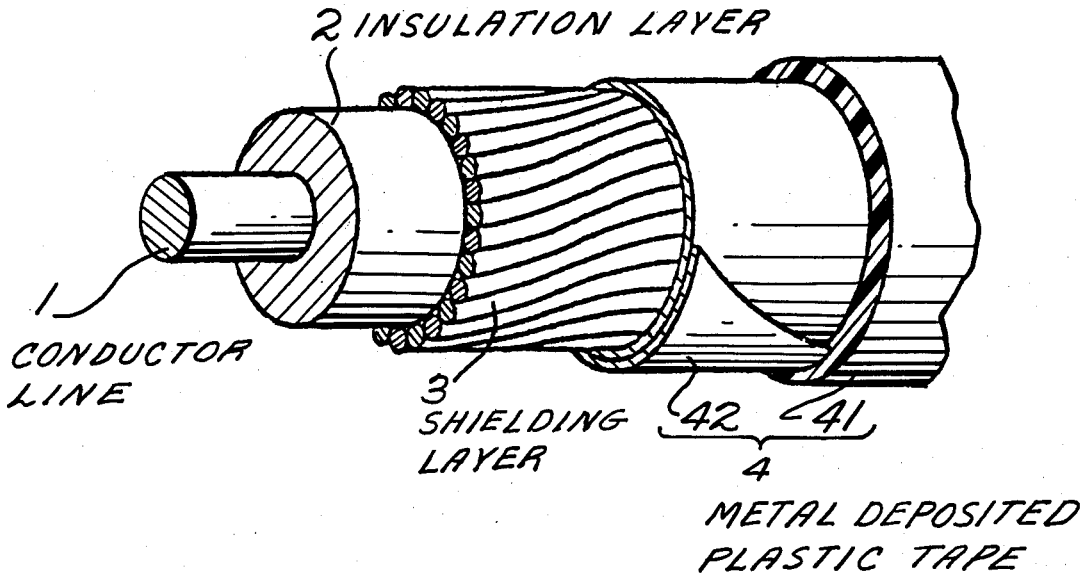
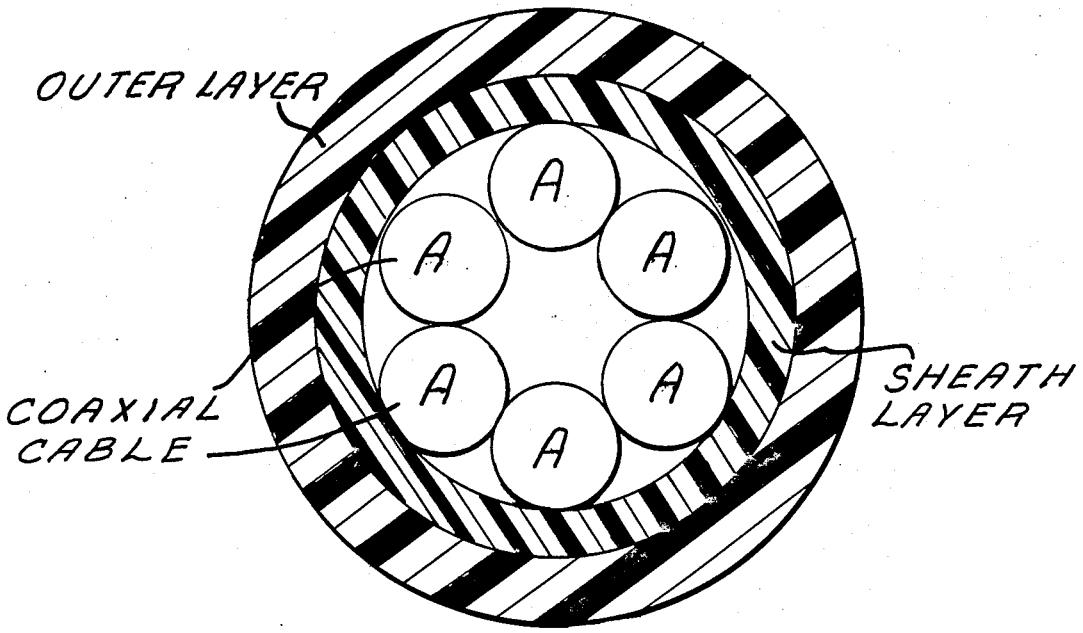
Fig. 3.

COAXIAL CABLE

BACKGROUND OF THE INVENTION

1. Field of the Invention

The present invention relates to a coaxial cable having a laterally wound shielding layer for use in, for example, an ultrasonic diagnostic device.

2. Description of the Prior Art

In an ordinary coaxial cable, a woven metallic member is used as a shielding layer to enhance shielding characteristics for the purpose of increasing surface density of the shielding layer. Dual woven metallic layers for this purpose are generally known. In a conventional structure of this type, however, the outer diameter of the cable becomes large, and sufficient flexibility of the cable has not been obtainable.

To remedy these problems, a plurality of copper wires have been spirally wound to provide a laterally wound shielding layer as the shielding layer in order to reduce the outer diameter of the cable and yet provide a given flexibility. Such a coaxial cable is available if it is used for low frequency bandwidths around 1 MHz, for example. However, the laterally wound shield does not provide a sufficient shielding characteristic due to the continuous slide of the copper wires, and the resultant coaxial cable is insufficiently shielded when used with an ultrasonic diagnostic device which requires a bandwidth of 10 MH or more. Therefore, a coaxial cable having a minimized outer diameter, yet providing a sufficient shielding characteristic against high frequency bandwidths, has not heretofore between realized.

In order to overcome the above-mentioned drawbacks, it is conceivable to design a coaxial cable in which the laterally wound shielding layer is wound with an aluminum foil tape or with a composite tape in which the aluminum foil is adhered on the plastic tape. However, the latter type of coaxial cable is not sufficiently flexible; therefore, the aluminum foil may be broken and the shielding characteristic may be degraded over time. Such problems are compounded if the cable is used in a diagnostic device which requires a severe bending condition of the cable.

SUMMARY OF THE INVENTION

It is, therefore, an object of this invention to overcome the above-described drawbacks by providing an improved coaxial cable having a minimized outer diameter, sufficient flexibility and sufficient shielding characteristics.

The coaxial cable according to the present invention has a metal deposited tape wound over the laterally wound shielding layer which is formed over an insulation layer, the metal deposited tape including a plastic tape and a metal deposition layer deposited on the plastic tape, wherein the metal deposition layer is in electrical contact with the laterally wound shielding layer.

BRIEF DESCRIPTION OF THE DRAWINGS

FIG. 2 is a side view showing the coaxial cable of the embodiment of FIG. 1.

FIG. 3 is a cross-sectional view showing a plurality of cables stranded together so as to form a composite coaxial cable.

DETAILED DESCRIPTION OF THE PREFERRED EMBODIMENT

Figure 1:
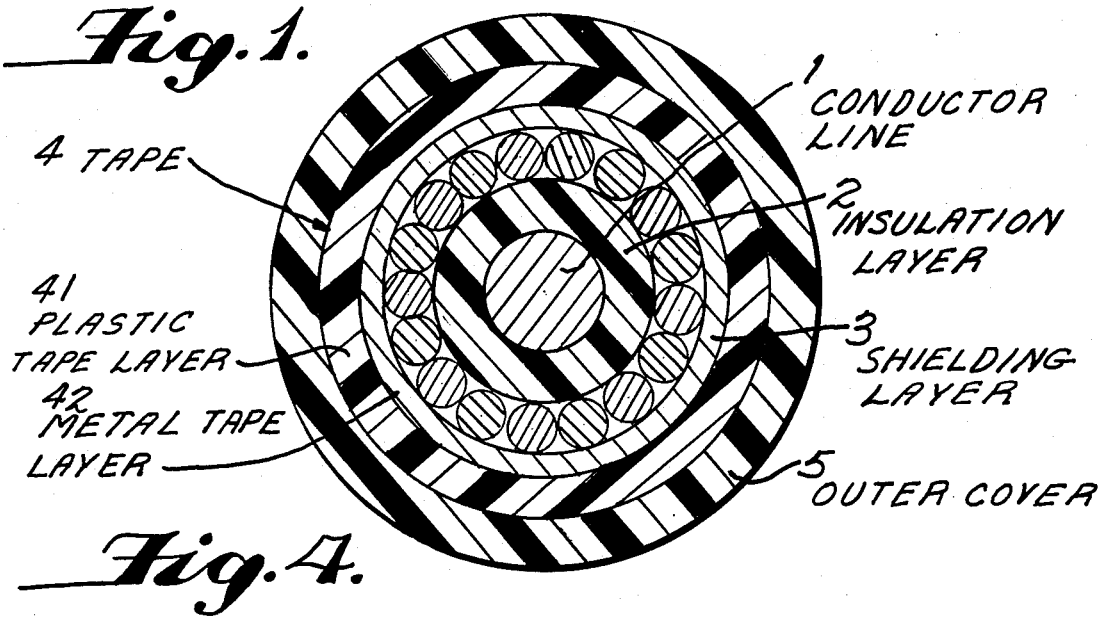
FIG. 1 is a cross-sectional view showing a coaxial cable according to one embodiment of the present invention.

In FIGS. 1 and 2, reference numeral 1 designates a conductor line in which soft copper wires and tinplated soft copper wires are stranded together. Reference number 2 designates an insulation layer which is provided by winding an insulating tape sufficient for insulating the high frequency wave used, and may include insulating tapes such as foamed polyethylene tape and foamed polytetrafluoroethylene tape. Reference numeral 3 designates a laterally wound shielding layer in which a plurality of soft copper wires and tin-plated soft copper wires are laterally wound by a predetermined pitch. Over the laterally wound shielding layer 3 is wound a metal depositing tape 4 in which a deposition layer 42 of electrically conductive metal such as copper or tin is deposited onto a plastic tape 41 such as polyester tape, and the deposition layer 42 is positioned radially inwardly so as to contact the laterally wound shielding layer 3. An outer cover layer 5 formed of plastic material tape is then wound over the metal depositing layer 4. The outer cover layer 5 may be made integral with the plastic tape 41 of the metal depositing tape 4 by heating and the like, as shown in FIG. 2.

A single core coaxial cable is shown in FIGS. 1 and 2; however, composite coaxial cables can also be used in accordance with the present invention by stranding together a plurality of the above coaxial cables A and forming a sheath layer of polyethylene and polyvinyl chloride over the stranded coaxial cables, as shown in FIG. 3.

The thickness of the metal deposition layer 42 of the meal depositing tape 4 must be at least 0.2 μm in order to obtain a sufficient shielding characteristic. More particularly, if the metal deposition layer 42 has a thickness of about 1 μm, a greatly improved shielding characteristic is attainable. Such a coaxial cable may used even if the number of conductive wires is reduced in such a manner as to provide about a 50% surface density. As a result, the cable weight can be reduced in accordance with this embodiment.

EXAMPLE

Seven copper wires, each having a diameter of 0.04 mm, were stranded together to form the central conductor member 1, and an insulation layer 2 made of foamed polytetrafluoroethylene tape was wound over the conductor member 1 so that the resultant outer diameter became 0.37 mm. Then, twenty-six tin-plated soft copper wires 3, each having a diameter of 0.05 mm, were laterally wound about insulation layer 2 at a 9.5 mm pitch. Over the laterally wound layer 3, a copper deposited polyester tape according to the present invention was wound so that the metal deposited layer portion 42 having a metal deposition thickness of about 1 μm was radially inwardly positioned, and over the laterally wound layer, a conventional polyester tape 41 having a thickness of 6 μm and a width of 4 mm was wound. Two polyester tapes were overlapped with each other with a mutual displacement of about $\frac{1}{3}$ of their respective areas. Comparative experiments were then conducted to determine the shielding characteristic.

Figure 4:
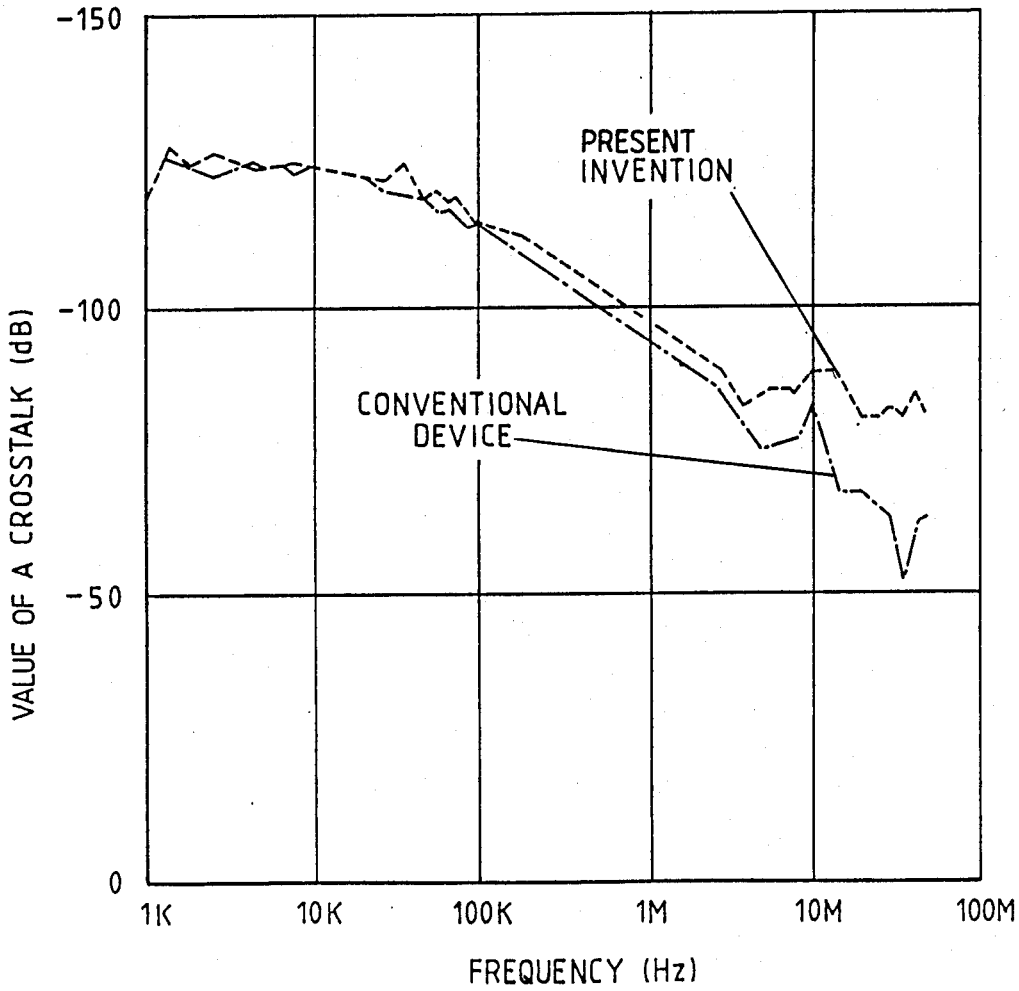
FIG. 4 is a characteristic curve showing a comparison of the shielding characteristic of the present invention with that of a conventional coaxial cable.

For testing the shielding characteristic, two specimens, each having a length of 2.9 m, were stranded by a stranding pitch of 25 mm. Each of the stranded samples was terminate with 100 Ω resistance for measuring the value of crosstalk. The results of this test are shown in FIG. 4. As shown, particularly great improvement has been achieved at high frequency bandwidths over 4 MHz.

As described above, according to the coaxial cable of this invention, the shielding characteristic is greatly improved in comparison with the conventional coaxial cable having a laterally wound shield without any increase in outer diameter. Furthermore, the metal deposition layer of the present invention may be sufficiently bonded to the plastic tape by deposition so that the shielding characteristic may be maintained even under a severe bending condition of the cable. Accordingly, a multi-core assembly of coaxial cables in accordance with the present invention may be used in high density in an ultrasonic diagnostic device which requires sufficient shielding characteristics at high frequency bandwidths, and the resulting assembly may be compact and light in weight.

I claim:

1. A coaxial cable having a central conductor, comprising:

an insulation layer wound around said conductor;

a laterally wound shielding layer formed of a plurality of wires wound at a predetermined pitch around said insulation layer; and a metal tape wound over said shielding layer, said tape including a plastic tape and a metal layer which is deposited on said plastic tape, said metal layer being in contact with said shielding layer.

2. A coaxial cable as claimed in claim 1, wherein said metal layer has a thickness of at least 0.2 μm.

3. A coaxial cable as claimed in claim 1, wherein said metal layer has a thickness of approximately 1 μm.

4. A coaxial cable as claimed in claim 1, wherein said metal layer is formed of at least one of copper and tin.

5. A composite coaxial cable comprising:

a plurality of coaxial cables having a central conductor, said coaxial cables being spirally wound about each other, each of said coaxial cables comprising an insulation layer wound around said concductor, a laterally wound shielding layer formed of a plurality of wires wound at a predetermined pitch around said insulation layer, and a tape wound over said shielding layer, said tape including a plastic tape and a metal layer which is deposited on said plastic tape, said metal layer being in contact with said shielding layer; and an outer cover layer formed over said spirally wound coaxial cables.

* * * * *

US004847448C1

(12) EX PARTE REEXAMINATION CERTIFICATE (5986th)

United States Patent

Sato

(10) Number: US 4,847,448 C1

(45) Certificate Issued: Nov. 6, 2007

(54) COAXIAL CABLE

(75) Inventor: Kazuhiro Sato, Tochigi (JP)

(73) Assignee: Sumitomo Electric Industries, Ltd., Osaka (JP)

Reexamination Request:
No. 90/005,944, Mar. 2, 2001

Reexamination Certificate for:

| | |
|---|---|
| Patent No.: | **4,847,448** |
| Issued: | **Jul. 11, 1989** |
| Appl. No.: | **07/190,173** |
| Filed: | **May 4, 1988** |

(30) Foreign Application Priority Data

Jul. 21, 1987 (JP) ..... 62-182829

(51) Int. Cl.
*H01B 7/34* (2006.01)

(52) U.S. Cl. ..... 174/103; 174/36; 174/106 R; 174/108; 333/243

(58) Field of Classification Search ..... 174/103, 174/36, 106 R, 108; 333/243
See application file for complete search history.

(56) References Cited

U.S. PATENT DOCUMENTS

| | | | | |
|---|---|---|---|---|
| 3,217,094 A | | 11/1965 | Volk | 174/120 |
| 3,274,329 A | | 9/1966 | Timmons | 174/69 |
| 4,187,390 A | | 2/1980 | Gore | 174/102 R |
| 4,197,348 A | * | 4/1980 | Townsend | |

FOREIGN PATENT DOCUMENTS

| | | |
|---|---|---|
| AU | 216883 | 8/1958 |
| FR | 1554181 | 12/1968 |
| JP | 48-40772-01 | 9/1946 |
| JP | 55-59409 | 10/1953 |
| JP | 60-174018 | 11/1960 |
| JP | 58-155312 | 4/1963 |
| JP | 55-41622 | 9/1978 |
| JP | 59-170321 | 11/1984 |

OTHER PUBLICATIONS

Furukawa Denko, Jiho, vol. 76, "The Cable for Ultrasonic Medical Equipment", Publication (FDJ).

* cited by examiner

*Primary Examiner*—Chau N. Nguyen

(57) ABSTRACT

A coaxial cable having a tape with a metal deposited thereon which is wound over a laterally wound shielding layer which is, in turn, formed over an insulation layer about the conductor. The tape includes a plastic tape and a metal layer deposited on the plastic tape, and the tape is disposed such that the metal layer is in contact with the laterally wound shielding layer. Improved high frequency shielding characteristics are obtained using this structure without sacrificing cable flexibility.

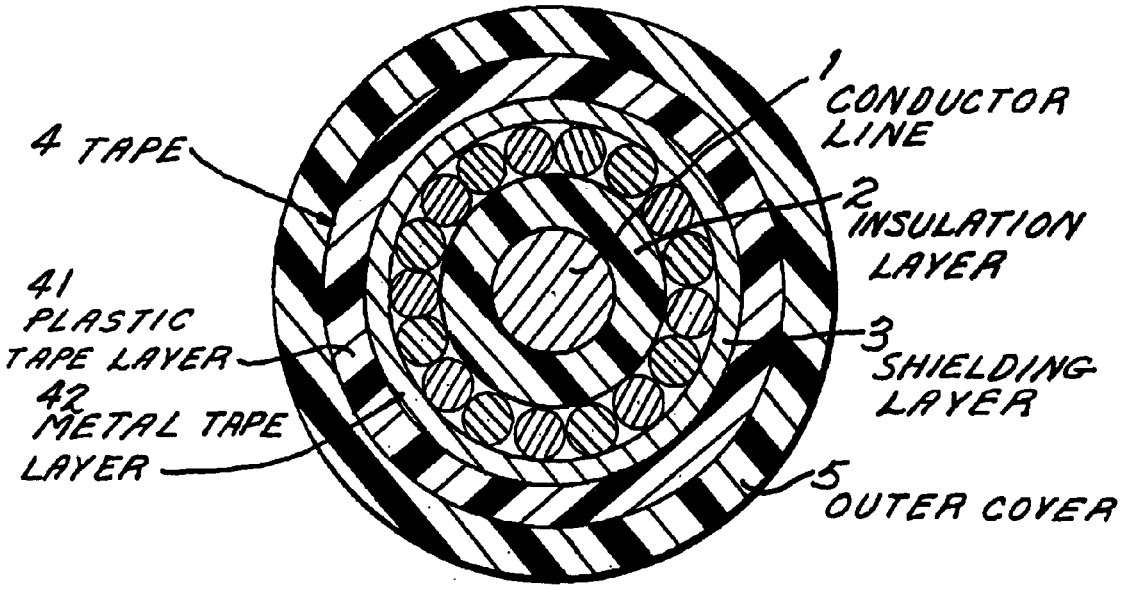

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 5 are determined to be patentable as amended.

Claims 2, 3 and 4, dependent on an amended claim, are determined to be patentable.

New claims 6, 7, 8 and 9 are added and determined to be patentable.

1. A coaxial cable having a central conductor, comprising:

an insulation layer wound around said conductor;

a laterally wound shielding layer formed of a plurality of wires wound at a predetermined pitch around said insulation layer; [and]

a metal tape wound over said shielding layer, said tape including a plastic tape and a metal layer which is deposited on said plastic tape, said metal layer being in contact with said shielding layer*; and*

*a plastic material tape forming a cover layer and being wound over the metal tape and made integral with the plastic tape by heating.*

5. A composite coaxial cable comprising:

a plurality of coaxial cables having a central conductor, said coaxial cables being spirally wound about each other, each of said coaxial cables comprising an insulation layer wound around said conductor, a laterally wound shielding layer formed of a plurality of wires wound at a predetermined pitch around said insulation layer, [and] a *metal* tape wound over said shielding layer, said tape including a plastic tape and a metal layer which is deposited on said plastic tape, said metal layer being in contact with said shielding layer; [and]

*a plastic material tape forming a cover layer and being wound over the metal tape and made integral with the plastic tape by heating; and* an outer cover layer formed over said spirally wound coaxial cables.

*6. A coaxial cable as claimed in claim 1, wherein said insulation layer is formed on said conductor.*

*7. A coaxial cable as claimed in claim 5, wherein said insulation layer is formed on said conductor.*

*8. A coaxial cable having a central conductor, comprising:*

*an insulation layer wound around said conductor;*

*a laterally wound shielding layer formed of a plurality of wires wound at a predetermined pitch around said insulation layer;*

*a metal tape wound over said shielding layer, said tape including a plastic tape and a metal layer which is deposited on said plastic tape, said metal layer being in contact with said shielding layer; and*

*a plastic material tape forming a cover layer and being wound over the metal tape and made integral with the plastic tape by heating,*

*wherein said metal layer has a thickness of at least 0.2 μm and is formed of at least one of copper and tin.*

*9. A coaxial cable as claimed in claim 8, wherein said insulation layer is formed on said conductor.*

* * * * *